US006784861B2

(12) United States Patent
Okada

(10) Patent No.: US 6,784,861 B2
(45) Date of Patent: Aug. 31, 2004

(54) LIQUID-CRYSTAL DISPLAY DEVICE AND METHOD OF SIGNAL TRANSMISSION THEREOF

(75) Inventor: Kayo Okada, Tokyo (JP)

(73) Assignee: NEC Electronics Corporation, Kanagawa (JP)

( * ) Notice: Subject to any disclaimer, the term of this patent is extended or adjusted under 35 U.S.C. 154(b) by 166 days.

(21) Appl. No.: 10/236,280

(22) Filed: Sep. 6, 2002

(65) Prior Publication Data

US 2003/0058213 A1 Mar. 27, 2003

(30) Foreign Application Priority Data

Sep. 6, 2001 (JP) ..... 2001-270942

(51) Int. Cl.[7] ..... G09G 3/36

(52) U.S. Cl. ..... 345/87; 345/211; 345/213; 345/209; 345/54; 345/79

(58) Field of Search ..... 345/87–100, 211–213, 345/209, 79, 54

(56) References Cited

U.S. PATENT DOCUMENTS 5,093,655 A * 3/1992 Tanioka et al. ..... 345/96
5,122,790 A * 6/1992 Yasuda et al. ..... 345/96
5,568,163 A * 10/1996 Okumura ..... 345/100
5,691,739 A * 11/1997 Kawamori et al. ..... 345/58
5,757,365 A * 5/1998 Ho ..... 345/212
6,008,801 A * 12/1999 Jeong ..... 345/204
6,061,046 A * 5/2000 An ..... 345/98
6,369,791 B1 * 4/2002 Kudo et al. ..... 345/100
6,456,267 B1 * 9/2002 Sato et al. ..... 345/92
6,611,247 B1 * 8/2003 Chang et al. ..... 345/99
6,621,489 B2 * 9/2003 Yanagisawa et al. ..... 345/211
6,625,207 B1 * 9/2003 Nitta et al. ..... 375/219
6,677,937 B1 * 1/2004 Takahashi et al. ..... 345/212

* cited by examiner

*Primary Examiner*—Richard Hjerpe
*Assistant Examiner*—Kimnhung Nguyen
(74) *Attorney, Agent, or Firm*—Choate, Hall & Stewart

(57) ABSTRACT

A LCD device has a decreased number of required transmission lines. The first interface circuit, which is provided in the controller circuit, receives the polarization reverse signal and the horizontal scanning signal in parallel in such a way that the polarization reverse signal and the horizontal scanning signal have their active periods at different timings. The first interface circuit generates a serial signal from the polarization reverse signal and the horizontal scanning signal, and transmits the serial signal to the data electrode driver circuit by way of the transmission line or lines. The second interface circuit, which is provided in the data electrode driver circuit, regenerates the polarization reverse signal and the horizontal scanning signal in parallel from the serial signal.

7 Claims, 12 Drawing Sheets

LIQUID-CRYSTAL DISPLAY DEVICE AND METHOD OF SIGNAL TRANSMISSION THEREOF

BACKGROUND OF THE INVENTION

1. Field of the Invention

The present invention relates generally to Liquid-Crystal Display (LCD) devices. More particularly, the invention relates to a LCD device having comparatively long transmission lines for transmitting internal signals, and a method of transmitting signals in the same device.

2. Description of the Related Art

With LCD devices, generally, the controller circuit outputs an image input signal to be displayed, a polarization reverse signal, a horizontal scanning signal, and a vertical scanning signal. The image input signal is taken into the data electrode driver circuit to be synchronized with the horizontal scanning signal. The pixel data signal corresponding to the image input signal thus taken into is polarization-reversed according to the polarization reverse signal and then, it is sent to the respective data electrodes of the LCD panel from the data electrode driver circuit. The vertical scanning signal is taken into the scanning electrode driver circuit. A scanning signal is sent to the scanning electrode driver circuit to be synchronized with the vertical scanning signal by the scanning electrode driver circuit. The pixel data signal is supplied to the specific pixel regions on the panel chosen by the scanning signal, thereby displaying images on the screen of the panel according to the pixel data signal. The data electrode driver circuit comprises a data electrode driver section or sections. The scanning electrode driver circuit comprises a scanning electrode driver section or sections.

FIG. 1 shows the circuit configuration of an example of the prior-art LCD devices of the type described here. This device comprises a LCD panel 1, a controller circuit 2, a gray scale power supply circuit 3, a data electrode driver circuit 4, and a scanning electrode driver circuit 5.

The LCD panel 1 includes a color filter for generating color images by dividing each pixel into a sub-pixel of red (R), a sub-pixel of green (G), and a sub-pixel of blue (B). The panel 1 further includes n data electrodes X1 to Xn (n: a positive integer greater than 2) to be applied with corresponding sub-pixel data signals D, m scanning electrodes Y1 to Ym (m: a positive integer greater than 2) to be applied with corresponding scanning signals V, and sub-pixel regions (not shown) formed at the respective intersections of the data electrodes X1 to Xn and the scanning electrodes Y1 to Ym, The specific sub-pixel regions chosen by the scanning signals V are applied with the corresponding sub-pixel data signals D, thereby displaying color images on the screen (not shown) of the panel 1 according to the signals D.

The controller circuit 2, which is formed by, for example, an ASIC (Application Specific Integrated Circuit), supplies 8-bit red data DR, 8-bit green data DGr and 8-bit blue data DB to the data electrode driver circuit 4. These data DR, DG, and DB are supplied to the circuit 2 from the outside of the LCD device. The circuit 2 generates a horizontal scanning signal PH, a vertical scanning signal PV, and a polarization reverse signal POL, based on a horizontal synchronization signal SH and a vertical synchronization signal SV, and so on supplied from the outside of the LCD device. The polarization reverse signal POL is used for alternating-current (AC) driving the panel 1. The circuit 2 supplies the horizontal scanning signal PH and the polarization reverse signal POL thus generated to the data electrode driver circuit 4 in the voltage mode and at the same time, it supplies the vertical scanning signal PV thus generated to the scanning electrode driver circuit 5 in the voltage mode. Moreover, the circuit 2 supplies a red scale voltage data DGR, a green scale voltage data DGG, and a blue scale voltage data DGB to the gray scale power supply circuit 3, which are used for giving desired gradation to the data DR, DG, and DB through gamma (γ) compensation, respectively.

The gray scale power supply circuit 3 comprises three digital-to-analog converter (DAC) circuits $\mathbf{11}_1$, $\mathbf{11}_2$, and $\mathbf{11}_3$ and 54 voltage follower circuits $\mathbf{12}_1$ to $\mathbf{12}_{54}$, as shown in FIG. 2. The DAC circuit $\mathbf{11}_1$converts the digital red scale voltage data DGR to 18 analog red scale voltages $V_{R0}$ to $V_{R17}$ and then, the circuit $\mathbf{11}_1$ supplies the voltages $V_{R0}$ to $V_{R17}$ to the voltage follower circuits $\mathbf{12}_1$ to $\mathbf{12}_{18}$, respectively. Similarly, the DAC circuit $\mathbf{11}_2$ converts the digital green scale voltage data DGG to 18 analog green scale voltages $V_{G0}$ to $V_{G17}$ and then, the circuit $\mathbf{11}_2$ supplies the voltages $V_{G0}$ to $V_{17}$ to the voltage follower circuits $\mathbf{12}_{19}$ to $\mathbf{12}_{36}$, respectively. The DAC circuit $\mathbf{11}_3$ converts the digital blue scale voltage data DGB to 18 analog blue scale voltages $V_{B0}$ to $VB_{17}$ and then, the circuit $\mathbf{11}_3$ supplies the voltages $V_{B0}$ to $VB_{B17}$ to the voltage follower circuits $\mathbf{12}_{37}$ to $\mathbf{12}_{54}$, respectively. The analog red scale voltages $V_{R0}$ to $V_{R17}$, the analog green scale voltages $V_{G0}$ to $V_{G17}$, and the analog blue scale voltages $V_{B0}$ to $V_{B17}$ are used for γ-compensation to the red data DR, green data DG, and blue data DB, respectively. The voltage follower circuits $\mathbf{12}_1$ to $\mathbf{12}_{54}$ receive the analog red, green, and blue scale voltages $V_{R0}$ to $V_{R17}$, $V_{G0}$ to $V_{G17}$, or $V_{B0}$ to $V_{B17}$ at high input impedance, respectively, and outputs them to the data electrode driver circuit 4 at low output impedance.

The data electrode driver circuit 4 comprises k (k: a natural number) data electrode driver sections $\mathbf{4}_l$ to $\mathbf{4}_k$. Each of the sections $\mathbf{4}_l$ to $\mathbf{4}_k$ applies the specific γ-compensation to the red, green, and blue data DR, DG, and/or DE based on the red, green, and blue scale voltages $V_{R0}$ to $V_{R17}$, $V_{G0}$ to $V_{G17}$, and/or $V_{B0}$ to $V_{B17}$ to thereby give gradation thereto. Then, the circuit 4 converts the red, green, and blue data DR, DG, and/or DB thus compensated to 384 sub-pixel data signals D and then, outputs the signals D to the data electrodes X1 to Xn on the panel 1.

For example, if the panel 1 is designed for the SXGA (Super extended Graphics Array) resolution or mode, the panel 1 has 1280 pixels (horizontal)×1024 pixels (vertical) in total. In this case, the count of the sub-pixels is 3840 pixels (horizontal)×1024 pixels (vertical), because each pixel is formed by three sub-pixels, i.e., a red sub-pixel, a green sub-pixel, and a blue sub-pixel. Here, (3840 pixels)/(384 data signals)=10 (pixels/data signal). Thus, the total number of the data electrode driver sections is 10; i.e., k=10. This means that the data electrode driver circuit 4 comprises 10 data electrode driver sections $\mathbf{4}_1$ to $\mathbf{4}_{10}$. The following explanation is made under the condition described here.

The data electrode driver sections $\mathbf{4}_1$ to $\mathbf{4}_{10}$ have the same circuit configuration as each other except for the suffixes of the respective elements and the respective signals. Thus, only the section $\mathbf{4}_1$ is explained below.

The data electrode driver section $\mathbf{4}_1$ of the data electrode driver circuit 4 comprises three multiplexer (MPX) circuits $\mathbf{13}_1$ to $\mathbf{13}_3$, three 8-bit DAC (Digital-to-Analog Converter) circuits $\mathbf{14}_1$ to $\mathbf{14}_3$, and 384 voltage follower circuits $\mathbf{15}_1$ to $\mathbf{15}_{384}$, as shown in FIG. 3.

The MPX circuit $\mathbf{13}_1$ receives the red scale voltages $V_{R0}$ to $V_{R17}$ from the gray scale power supply circuit 3 and then, alternately supplies the set of the red scale voltages $V_{R0}$ to $VR_8$ or the set of the red scale voltages $V_{R9}$ to $V_{R17}$ to the DAC circuit $\mathbf{14}_1$ according to the polarization reverse signal POL from the controller circuit 2. Similarly, the MPX circuit $\mathbf{13}_2$ receives the green scale voltages $V_{G0}$ to $V_{G17}$ from the power supply circuit 3 and then, alternately supplies the set of the green scale voltages $V_{G0}$ to $V_{G8}$ or the set of the green scale voltages $V_{G9}$ to $V_{G17}$ to the DAC circuit $\mathbf{14}_2$ according to the polarization reverse signal POL. The MPX circuit $\mathbf{13}_3$ receives the blue scale voltages $V_{B0}$ to $V_{B17}$ from the power supply circuit 3 and then, alternately supplies the set of the blue scale voltages $V_{B0}$ to $V_{B8}$ or the set of the blue scale voltages $V_{B9}$ to $V_{B17}$ to the DAC circuit $\mathbf{14}_3$ according to the polarization reverse signal POL.

The DAC circuit $\mathbf{14}_1$ applies the specific γ-compensation to the 8-bit red data DR from the controller circuit 2 based on the set of the red scale voltages $V_{R0}$ to $V_{R8}$ or the set of the red scale voltages $V_{R9}$ to $V_{R17}$ from the MPX circuit $\mathbf{13}_1$, thereby giving gradation to the red data DR, Moreover, the circuit $\mathbf{14}_1$ converts the digital red data DR thus compensated to analog red data signals and then, supplies them to the corresponding voltage follower circuits $\mathbf{15}_1$, $\mathbf{15}_4$, $\mathbf{15}_7$, . . . , and $\mathbf{15}_{382}$. Similarly, the DAC circuit $\mathbf{14}_2$ applies the specific γ-compensation to the 8-bit green data DG from the controller circuit 2 based on the set of the green scale voltages $V_{G0}$ to $V_{G8}$ or the set of the green scale voltages $V_{G9}$ to $V_{G17}$ from the MPX circuit $\mathbf{13}_2$, thereby giving gradation to the green data DG. Moreover, the circuit $\mathbf{14}_2$ converts the digital green data DG thus compensated to analog green data signals and then, supplies them to the corresponding voltage follower circuits $\mathbf{15}_2$, $\mathbf{15}_5$, $\mathbf{15}_8$, . . . , and $\mathbf{15}_{383}$. The DAC circuit $\mathbf{14}_3$ applies the specific γ-compensation to the 8-bit blue data DB from the controller circuit 2 based on the set of the blue scale voltages $V_{B0}$ to $V_{B8}$ or the set of the blue scale voltages $V_{B9}$ to $V_{B17}$ from the MPX circuit $\mathbf{13}_3$, thereby giving gradation to the blue data DB. Moreover, the circuit $\mathbf{14}_3$ converts the digital blue data DB thus compensated to analog blue data signals and then, supplies them to the corresponding voltage follower circuits $\mathbf{15}_3$, $\mathbf{15}_6$, $\mathbf{15}_9$, . . . , and $\mathbf{15}_{384}$.

The voltage follower circuits $\mathbf{15}_1$ to $\mathbf{15}_{384}$ receive the corresponding red, green, and blue data signals at high input impedance and then, they send them to the corresponding data electrodes X1 to Xn at low output impedance as the sub-pixel data signals D.

The scanning electrode driver circuit 5 generates the scanning signals V to be synchronized with the vertical scanning signal PV sent from the controller circuit 2. Then, the circuit 5 supplies the scanning signals V thus generated to the corresponding scanning electrodes Y1 to Ym.

The controller circuit 2 and the gray scale power supply circuit 3 are mounted on the printed wiring board (PWB) 16, as shown in FIG. 4. The ten data electrode driver circuits $\mathbf{4}_1$ to $\mathbf{4}_{10}$ are respectively mounted on ten carrier tapes that connect electrically the PWB 16 to the panel 1, thereby forming ten tape carrier packages (TCPs) $\mathbf{17}_1$ to $\mathbf{17}_{10}$. The PWB 16 is attached to the top of the backlight unit 18, as shown in FIG. 5. The unit 18, which has an approximately wedge-shaped cross section, is located on the rear side of the panel 1. The unit 18 comprises a point source of light (e.g., a white lamp) or a linear source of light (e.g., a fluorescent lamp), and an optical diffuser for diffusing the light from the light source to thereby form a planar light source. The unit 18 is used to illuminate the back of the panel 1 uniformly, because the panel 1 itself does not emit light.

With the prior-art LCD device of FIG. 1, as shown in FIG. 6, the polarization reverse signal POL and the horizontal scanning signal PH, which are outputted from the controller circuit 2 in parallel, have their active mode periods at different timings. Specifically, when the horizontal scanning signal PH is in its active mode (i.e., in the logic high level), the polarization reverse signal POL is not in its active mode but is in its invalid state. On the other hand, when the polarization reverse signal POL is in its active mode, the horizontal scanning signal PH is not in its active mode.

The red scale voltages $V_{R0}$ to $V_{R17}$, which are supplied from the gray scale power supply circuit 3, are inputted into the MPX circuit 13, to be synchronized with the horizontal scanning signal PH. Thereafter, the set of the red scale voltages $V_{R0}$ to $V_{R8}$ or the set of the red scale voltages $V_{R9}$ to $V_{R17}$ are alternately supplied to the DAC circuit $\mathbf{14}_1$ according to the polarization reverse signal POL. Similarly, the green scale voltages $V_{G0}$ to $V_{G17}$, which are supplied from the gray scale power supply circuit 3, are inputted into the MPX circuit $\mathbf{13}_2$ to be synchronized with the horizontal scanning signal PH. Thereafter, the set of the green scale voltages $V_{G0}$ to $V_{G8}$ or the set of the green scale voltages $V_{G9}$ to $V_{G17}$ are alternately supplied to the DAC circuit $\mathbf{14}_2$ according to the polarization reverse signal POL. The blue scale voltages $V_{B0}$ to $V_{B17}$, which are supplied from the gray scale power supply circuit 3, are inputted into the MPX circuit $\mathbf{13}_3$ to be synchronized with the horizontal scanning signal PH. Thereafter, the set of the blue scale voltages $V_{B0}$ to $V_{B8}$ or the set of the blue scale voltages $V_{B9}$ to $V_{B17}$ are alternately supplied to the DAC circuit $\mathbf{14}_3$ according to the polarization reverse signal POL.

The 8-bit red data DR, which are supplied from the controller circuit 2 and inputted into the DAC circuit $\mathbf{14}_1$, are subjected to the γ-compensation in the DAC circuit $\mathbf{14}_1$ based on the set of the red scale voltages $V_{R0}$ to $V_{R0}$ or the set of the red scale voltages $V_{R9}$ to $V_{R17}$, thereby giving the gradation to the data DR. At the same time as this, the red data DR are converted to the analog red data signals. The analog red data signals thus obtained are supplied to the corresponding voltage follower circuits $\mathbf{15}_1$, $\mathbf{15}_4$, $\mathbf{15}_7$, . . . , and $\mathbf{15}_{382}$. Similarly, the 8-bit green data DG, which are supplied from the controller circuit 2 and inputted into the DAC circuit 142, are subjected to the γ-compensation in the DAC circuit $\mathbf{14}_2$ based on the set of the green scale voltages $V_{G0}$ to $V_{G8}$ or the set of the green scale voltages $V_{G9}$ to $V_{G17}$, thereby giving the gradation to the data DG. At the same time as this, the green data DG are converted to the analog green data signals. The analog green data signals thus obtained are supplied to the corresponding voltage follower circuits $\mathbf{15}_2$, $\mathbf{15}_5$, $\mathbf{15}_8$, . . . , and $\mathbf{15}_{383}$. The 8-bit blue data DB, which are supplied from the controller circuit 2 and inputted into the DAC circuit $\mathbf{14}_3$, are subjected to the γ-compensation in the DAC circuit $\mathbf{14}_3$ based on the set of the blue scale voltages $V_{B0}$ to $V_{B8}$ or the set of the blue scale voltages $V_{B9}$ to $V_{B17}$, thereby giving the gradation to the data DB. At the same time as this, the blue data DB are converted to the analog blue data signals. The analog blue data signals thus obtained are supplied to the corresponding voltage follower circuits $\mathbf{15}_3$, $\mathbf{15}_6$, $\mathbf{15}_9$, . . . , and $\mathbf{15}_{384}$.

The analog red, green, and blue data signals thus obtained are sent to the corresponding data electrodes X1 to Xn as the sub-data signals D.

The vertical scanning signal PV is supplied to the scanning electrode driver circuit 5 from the controller circuit 2. The scanning signals V are generated and outputted by the circuit 5 to the scanning electrodes Y1 to Ym to be synchronized with the signal PV. In the panel 1, the sub-pixel data signals D are respectively supplied to the specific sub-pixel regions chosen by the scanning signals V, thereby displaying color images on the screen (not shown) of the panel 1 according to the sub-pixel data signals D thus supplied.

With the above-described prior-art LCD device, there are the following problems.

The horizontal and vertical scanning signals PH and PV, the polarization reverse signal POL, the red, green, and blue data DR, DG, and DB, the red scale voltages $V_{R0}$ to $V_{R17}$, the green scale voltages $V_{G0}$ to $V_{G17}$, and the blue scale voltages $V_{B0}$ to $V_{B17}$ are all transmitted in the voltage mode. Therefore, if the prior-art LCD device is designed to be comparatively large, the transmission lines for these signals or data will be comparatively long. In this case, the signals or data are likely to be affected by the distributed constants or parameters (e.g., distributed capacitance, inductance, and resistance) in the transmission lines and thus, the signals and/or data thus transmitted may have "phase rotation" in their high-frequency regions. As a result, a problem that the image quality degrades may occur.

Moreover, since the distributed capacitors of the transmission lines are charged and discharged responsive to the voltage change of the respective signals, high-frequency noises are generated. These noises tend to affect EMI (Electro-Magnetic Interference) to other electronic equipment. This is another problem.

Furthermore, each of the horizontal and vertical scanning signals PH and PV requires a transmission line. The polarization reverse signal POL requires a transmission line. The 8-bit red data DR require eight transmission lines. The 8-bit green data DG require eight transmission lines. The 8-bit blue data DB require eight transmission lines. The red scale voltages $V_{R0}$ to $V_{R17}$ require eighteen transmission lines. The green scale voltages $V_{G0}$ to $V_{G17}$ require eighteen transmission lines. The blue scale voltages $V_{B0}$ to $V_{B17}$ require eighteen transmission lines. Therefore, if the PWB 16 and/or the TCPs $\mathbf{17}_1$ to $\mathbf{17}_{10}$ are designed to be small in size, a problem that required transmission lines are difficult or unable to be formed as desired will occur. Thus, it is necessary that the count of the transmission lines required is possibly decreased to cope with the tendency to make the LCD device more compact.

SUMMARY OF THE INVENTION

Accordingly, an object of the present invention is to provide a LCD device having a decreased number of required transmission lines, and a method of transmitting signals in the device.

Another object of the present invention is to provide a LCD device that prevents or suppresses the phase rotation and noises in the high-frequency regions of the signals to be transmitted in the device, and a method of transmitting signals in the device.

Still another object of the present invention is to provide a LCD device that avoids the EMI to other electronic equipment, and a method of transmitting signals in the device.

The above objects together with others not specifically mentioned will become clear to those skilled in the art from the following description.

According to a first aspect of the invention, a LCD device is provided, which comprises:

a LCD panel having data electrodes for receiving pixel data signals, scanning electrodes for receiving scanning signals, and pixel regions located at intersections of the data electrodes and the scanning electrodes;

part of the pixel regions being chosen by the scanning signals;

the pixel data signals being applied to the part of the pixel regions, displaying images corresponding to the pixel data signals applied;

a data electrode driver circuit for receiving an image input signal to be synchronized with a horizontal scanning signal, for polarization-reversing the pixel data signals corresponding to the image input signal based on a polarization reverse signal, and for transmitting the pixel data signals thus polarization-reversed to the data electrodes of the panel;

a scanning electrode driver circuit for transmitting scanning signals to the scanning electrodes of the panel to be synchronized with a vertical scanning signal; and a controller circuit for outputting the image input signal, the polarization reverse signal, the horizontal scanning signal, and the vertical scanning signal;

wherein the controller circuit comprises a first interface circuit for receiving the polarization reverse signal and the horizontal scanning signal in parallel in such a way that the polarization reverse signal and the horizontal scanning signal have their active mode periods at different timings, for generating a serial signal from the polarization reverse signal and the horizontal scanning signal, and for transmitting the serial signal to the data electrode driver circuit by way of a transmission line or lines;

and wherein the data electrode driver circuit comprises a second interface circuit for regenerating the polarization reverse signal and the horizontal scanning signal in parallel from the serial signal.

With the LCD device according to the first aspect of the invention, the first interface circuit is provided in the controller circuit. The first interface circuit receives the polarization reverse signal and the horizontal scanning signal in parallel in such a way that the polarization reverse signal and the horizontal scanning signal have their active mode periods at different timings. Further, the first interface circuit generates the serial signal from the polarization reverse signal and the horizontal scanning signal, and transmits the serial signal to the data electrode driver circuit by way of the transmission line or lines.

Moreover, the second interface circuit is provided in the data electrode driver circuit. The second interface circuit regenerates the polarization reverse signal and the horizontal scanning signal in parallel from the serial signal.

Accordingly, the total number of required transmission lines can be decreased, which makes it possible to cope with the tendency of making the LCD device more compact.

In a preferred embodiment of the device according to the first aspect of the invention, the device has a configuration that the serial signal is transmitted in a current mode. In this embodiment, the serial signal is transmitted in a current mode and therefore, the phase rotation in the high-frequency regions of the signals to be transmitted in the device can be avoided. This means that the quality of images is improved and at the same time, high-frequency noises can be reduced and the EMI to other electronic equipment can be avoided.

In another preferred embodiment of the device according to the first aspect of the invention, the first interface circuit comprises a parallel-to-serial converter circuit for converting the polarization reverse signal and the horizontal scanning signal transmitted in parallel to a first serial signal voltage; and a voltage-to-current converter circuit for converting the first serial signal voltage to a signal current. The signal current is outputted to the transmission line or lines. The second interface circuit comprises a current-to-voltage converter circuit for converting the signal current to a second signal voltage; and a serial-to-parallel converter circuit for converting the second signal voltage to the polarization reverse signal and the horizontal scanning signal in parallel.

In still another preferred embodiment of the device according to the first aspect of the invention, the data electrode driver circuit comprises at least one data electrode driver section according to a count of the data electrodes.

According to a second aspect of the invention, a method or transmitting signals in a LCD device is provided. The device comprises:

a LCD panel having data electrodes for receiving pixel data signals, scanning electrodes for receiving scanning signals, and pixel regions located at intersections of the data electrodes and the scanning electrodes;

part of the pixel regions being chosen by the scanning signals;

the pixel data signals being applied to the part of the pixel regions, displaying images corresponding to the pixel data signals applied;

a data electrode driver circuit for receiving an image input signal to be synchronized with a horizontal scanning signal, for polarization-reversing the pixel data signals corresponding to the image input signal based on a polarization reverse signal, and for transmitting the pixel data signals thus polarization-reversed to the data electrodes of the panel;

a scanning electrode driver circuit for transmitting scanning signals to the scanning electrodes of the panel to be synchronized with a vertical scanning signal; and a controller circuit for outputting the image input signal, the polarization reverse signal, the horizontal scanning signal, and the vertical scanning signal.

The controller circuit receives the polarization reverse signal and the horizontal scanning signal in parallel in such a way that the polarization reverse signal and the horizontal scanning signal have their active mode periods at different timings, generates a serial signal from the polarization reverse signal and the horizontal scanning signal, and transmits the serial signal to the data electrode driver circuit by way of a transmission line or lines.

The data electrode driver circuit regenerates the polarization reverse signal and the horizontal scanning signal in parallel from the serial signal.

With the method of transmitting a signal in a LCD device according to the second first aspect of the invention, the controller circuit and the data electrode driver circuit carry out the same operations as those in the LCD device according to the first aspect of the invention. Therefore, it is obvious that the same advantages as those in the device of the first embodiment are obtainable.

In a preferred embodiment of the method according to the second aspect of the invention, the serial signal is transmitted in a current mode. In this embodiment, the phase rotation in the high-frequency regions of the signals to be transmitted in the device can be avoided. This means that the quality of images is improved and at the same time, high-frequency noises can be reduced and the EMI to other electronic equipment can be avoided.

In another preferred embodiment of the method according to the second aspect of the invention, the controller circuit conducts a parallel-to-serial conversion step for converting the polarization reverse signal and the horizontal scanning signal transmitted in parallel to a first serial signal voltage; and a voltage-to-current conversion step for converting the first serial signal voltage to a signal current. The signal current is outputted to the transmission line or lines. The data electrode converter circuits conducts a current-to-voltage conversion step for converting the signal current to a second signal voltage; and a serial-to-parallel conversion step for converting the second signal voltage to the polarization reverse signal and the horizontal scanning signal in parallel.

BRIEF DESCRIPTION OF THE DRAWINGS

In order that the present invention may be readily carried into effect, it will now be described with reference to the accompanying drawings.

DETAILED DESCRIPTION OF THE PREFERRED EMBODIMENTS

Figure 1:
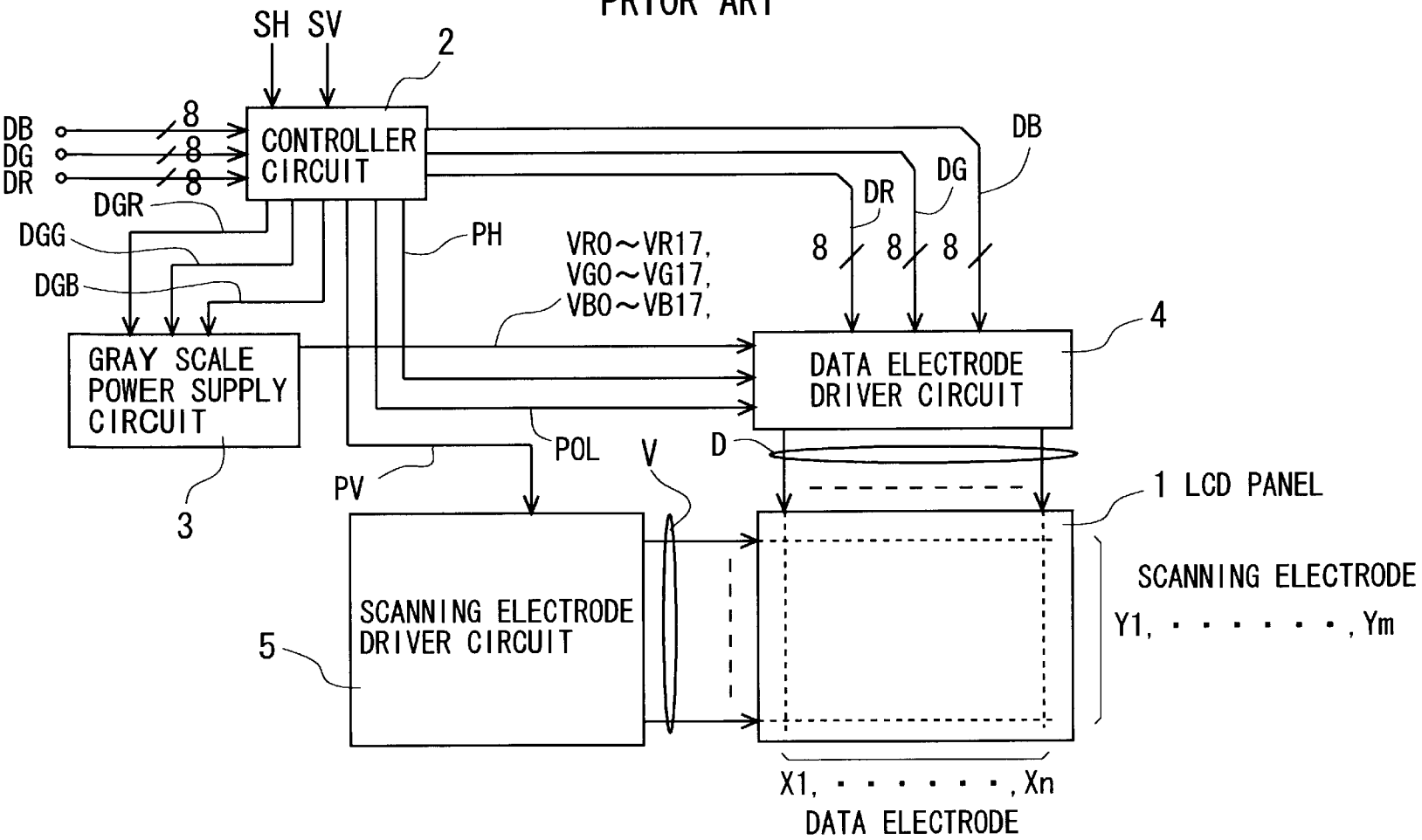
FIG. 1 PRIOR ART
FIG. 1 is a block diagram showing the configuration of an example of the prior-art LCD devices.
Figure 2:
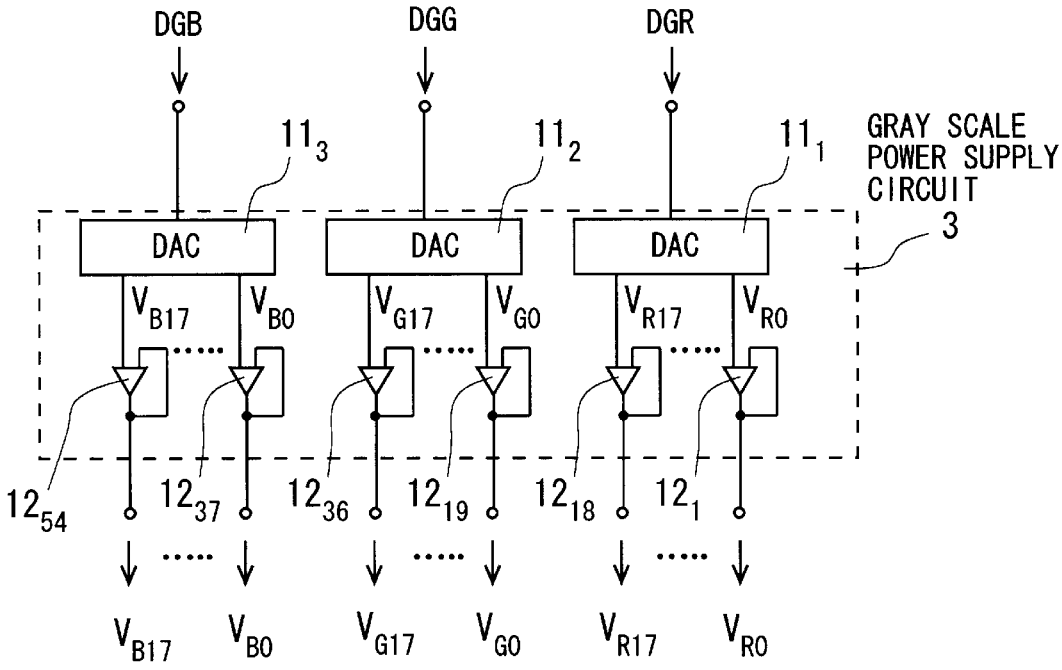
FIG. 2 PRIOR ART
FIG. 2 is a block diagram showing the configuration of the gray scale power supply circuit used in the prior-art LCD device of FIG. 1.
Figure 3:
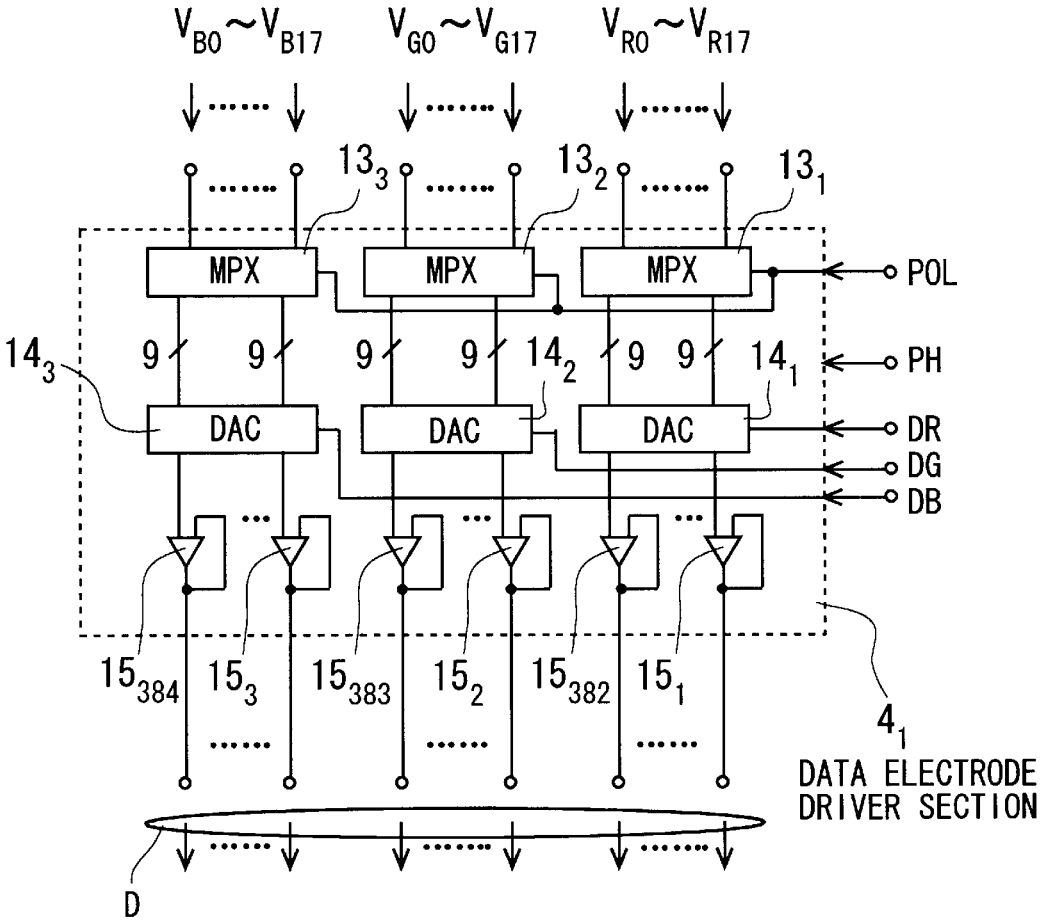
FIG. 3 PRIOR ART
FIG. 3 is a block diagram showing the configuration of the data electrode driver section of the data electrode driver circuit used in the prior-art LCD device of FIG. 1.
Figure 4:
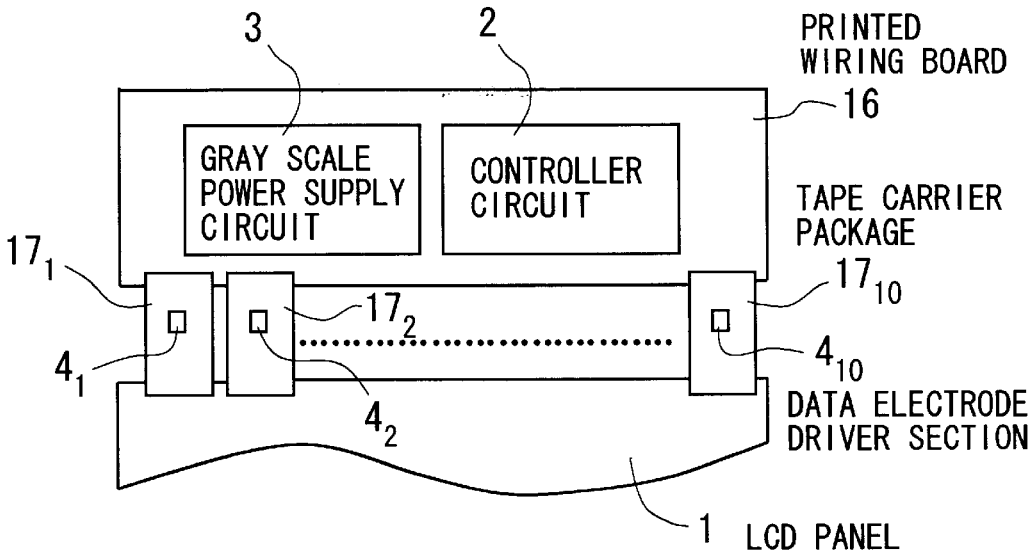
FIG. 4 PRIOR ART
FIG. 4 is a schematic view showing the mounting state of the data electrode driver sections of the data electrode driver circuit in the prior-art LCD device of FIG. 1.
Figure 5:
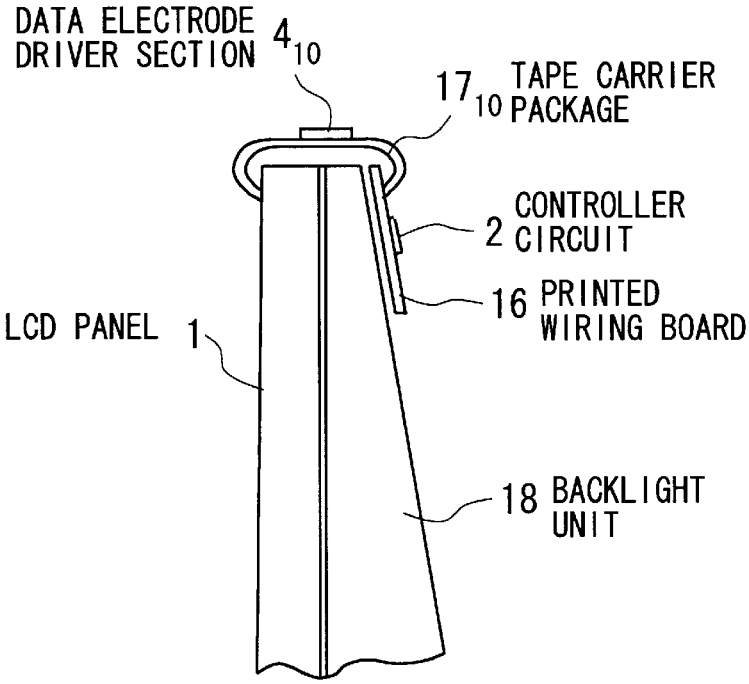
FIG. 5 PRIOR ART
FIG. 5 is a schematic view showing the mounting state of the data electrode driver sections of the data electrode driver circuit, the backlight unit, and the LCD panel in the prior-art LCD device of FIG. 1.
Figure 6:
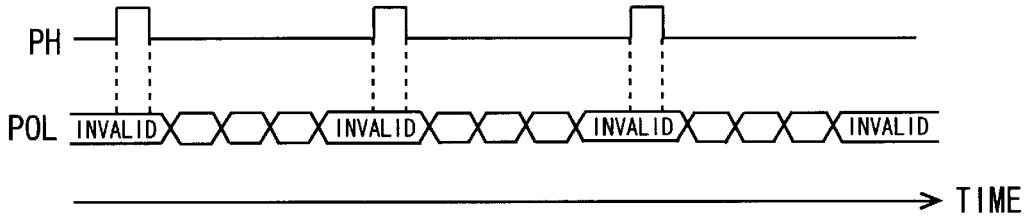
FIG. 6 PRIOR ART
FIG. 6 is a timing diagram showing the operation of the prior-art LCD device of FIG. 1, in which only the horizontal scanning signal PH and the polarization reverse signal POL are shown.

Preferred embodiments of the present invention will be described in detail below while referring to the drawings attached.

Figure 7:
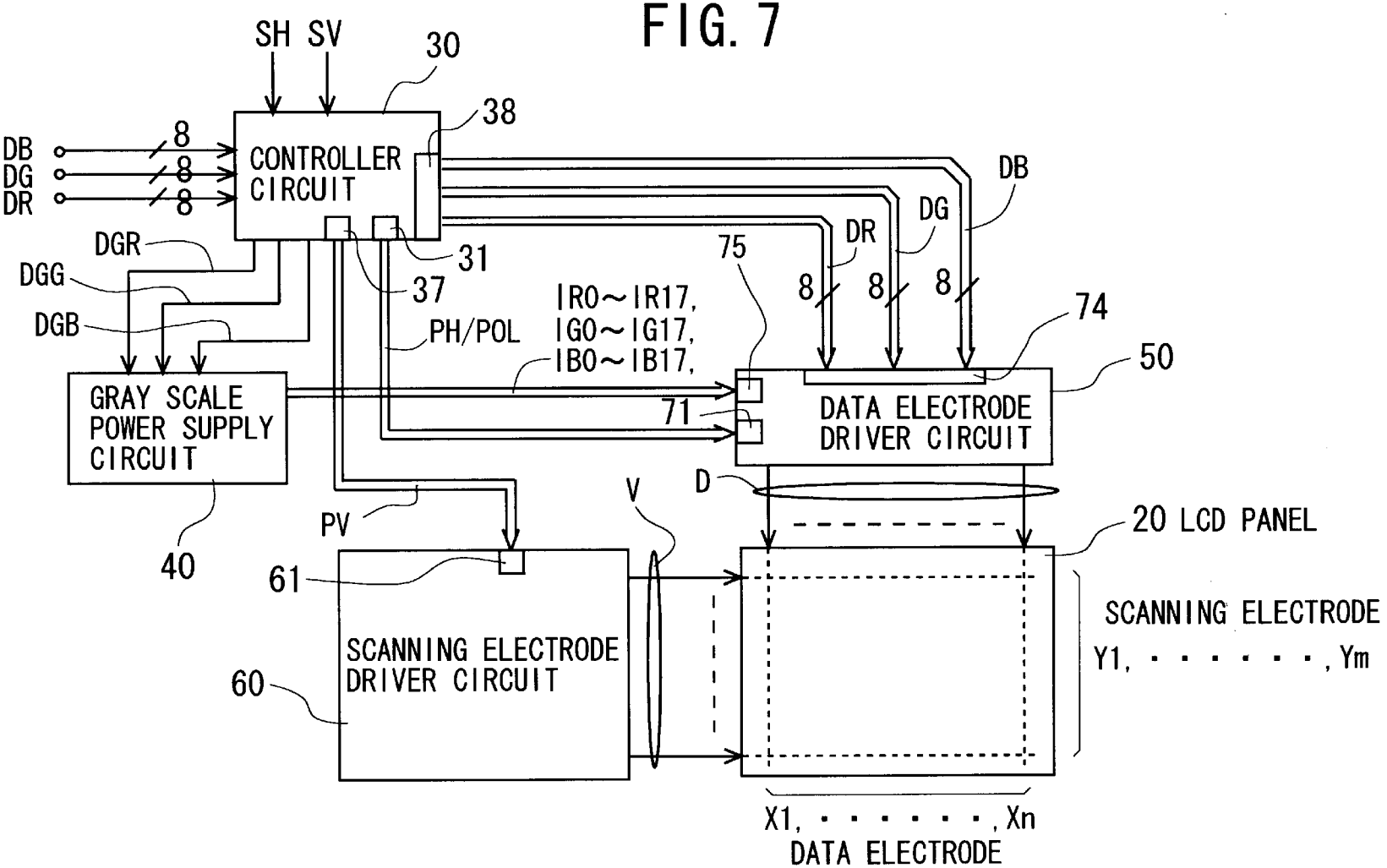
FIG. 7 is a block diagram showing the configuration of a LCD device according to an embodiment of the invention.

FIG. 7 shows the circuit configuration of a LCD device according to an embodiment of the invention. This device comprises a LCD panel 20, a controller circuit 30, a gray scale power supply circuit 40, a data electrode driver circuit 50, and a scanning electrode driver circuit 60.

The LCD panel 20 includes a color filter for generating color images by dividing each pixel to a sub-pixel of red (R), a sub-pixel of green (G), and a sub-pixel of blue (B). The panel 20 further includes n data electrodes X1 to Xn (n: a positive integer greater than 2) to be applied with corresponding sub-pixel data signals D, m scanning electrodes Y1 to Ym (m: a positive integer greater than 2) to be applied with corresponding scanning signals V, and sub-pixel regions (not shown) formed at the respective intersections of the data electrodes X1 to Xn and the scanning electrodes Y1 to Ym. The specific sub-pixel regions chosen by the scanning signals V are applied with the corresponding sub-pixel data signals D, thereby displaying color images on the screen (not shown) of the panel 20 according to the signals D.

The controller circuit 30, which is formed by, for example, an ASIC, supplies 8-bit red data DR, 8-bit green data DG, and 8-bit blue data DB in the current mode to the data electrode driver circuit 50. These data DR, DG, and DB are supplied to the circuit 30 from the outside of the LCD device. The circuit 30 generates a horizontal scanning signal PH, a vertical scanning signal PV, and a polarization reverse signal POL, based on a horizontal synchronization signal SH and a vertical synchronization signal SV, and so on supplied from the outside of the LCD device. The polarization reverse signal POL is used for AC driving the panel 20 at a specific period (e.g., the period of the R, G, and B sub-pixels). The circuit 30 supplies the horizontal scanning signal PH and the polarization reverse signal POL thus generated to the data electrode driver circuit 50 in the current mode in the form of the serial signal PH/POL. At the same time, the circuit 30 supplies the vertical scanning signal PV thus generated to the scanning electrode driver circuit 60 in the current mode. Moreover, the circuit 30 supplies a red scale voltage data DGR, a green scale voltage data DGG, and a blue scale voltage data DGB to the gray scale power supply circuit 40, which are used for giving desired gradation to the data DR, DG, and DB through y compensation, respectively.

Figure 8:
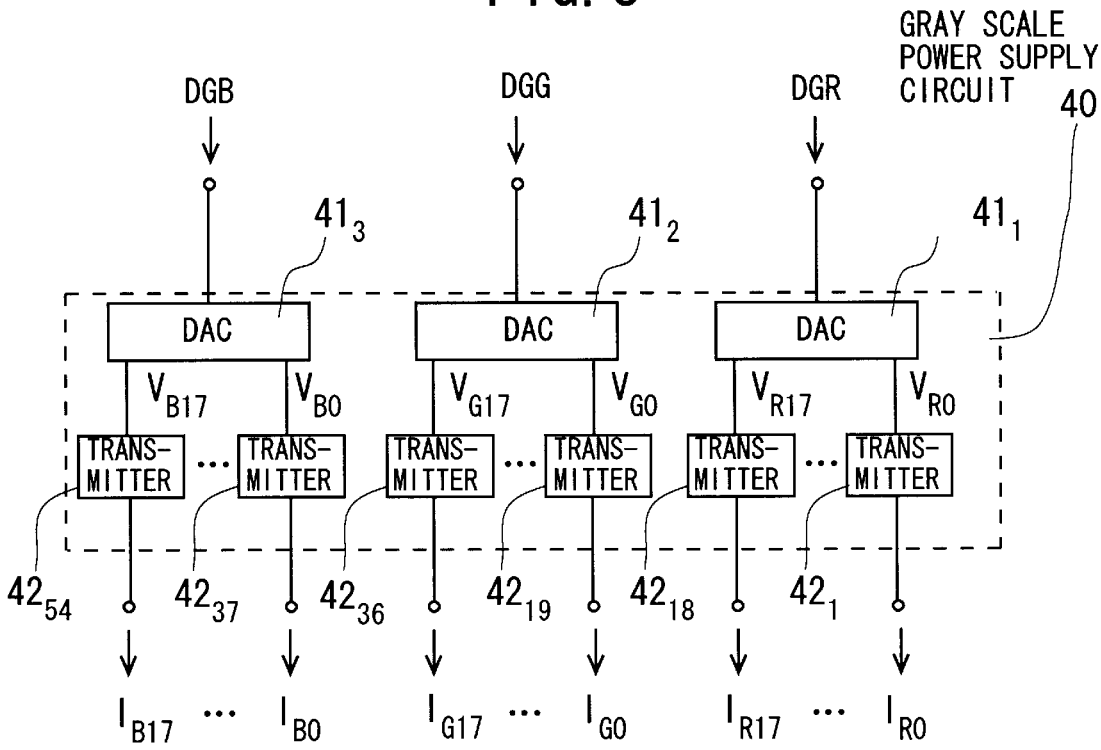
FIG. 8 is a block diagram showing the configuration of the gray scale power supply circuit used in the LCD device according to the embodiment of FIG. 7.

The gray scale power supply circuit 40 comprises three DAC circuits $\mathbf{41}_1$, $\mathbf{41}_2$, and $\mathbf{41}_3$ and 54 transmitter circuits $\mathbf{42}_1$ to $\mathbf{42}_{54}$, as shown in FIG. 8.

The DAC circuit $\mathbf{41}_1$ converts the digital red scale voltage data DGR to analog red scale voltages $V_{R0}$ to $V_{R17}$ and then, the circuit $\mathbf{41}_1$ supplies the analog voltages $V_{R0}$ to $V_{R17}$ to the transmitter circuits $\mathbf{42}_1$, to $\mathbf{42}_{18}$, respectively. Similarly, the DAC circuit $\mathbf{41}_2$ converts the digital green scale voltage data DGG to analog green scale voltages $V_{G0}$ to $V_{G17}$ and then, the circuit $\mathbf{41}_2$ supplies the analog voltages $V_{G0}$ to $V_{G17}$ to the transmitter circuits $\mathbf{42}_{19}$ to $\mathbf{42}_{36}$, respectively. The DAC circuit $\mathbf{41}_3$ converts the digital blue scale voltage data DGB to analog blue scale voltages $V_{B0}$ to $V_{B17}$ and then, the circuit $\mathbf{41}_3$ supplies the analog voltages $V_{B0}$ to $V_{B17}$ to the transmitter circuits $\mathbf{42}_{37}$ to $\mathbf{42}_{54}$, respectively. The analog red scale voltages $V_{R0}$ to $V_{R17}$, the analog green scale voltages $V_{G0}$ to $V_{G17}$, and the analog blue scale voltages $V_{B0}$ to $V_{B17}$ are used for γ-compensation to the red data DR, green data DG, and blue data DB, respectively.

The transmitter circuits $\mathbf{42}_1$ to $\mathbf{42}_{18}$ receive the analog red scale voltages $V_{R0}$ to $V_{R17}$ at high input impedance, respectively, and convert them to analog red scale currents $I_{R0}$ to $I_{R17}$, respectively. Thereafter, the circuits $\mathbf{42}_1$ to $\mathbf{42}_{18}$ output the analog red scale currents $I_{R0}$ to $I_{R17}$ thus obtained to the data electrode driver circuit 50 at low output impedance. Similarly, the transmitter circuits $\mathbf{42}_{19}$ to $\mathbf{42}_{36}$ receive the analog green scale voltages $V_{G0}$ to $V_{G17}$ at high input impedance, respectively, and convert them to analog green scale currents $I_{G0}$ to $I_{G17}$, respectively. Thereafter, the transmitter circuits $\mathbf{42}_{19}$ to $\mathbf{42}_{36}$ output the analog green scale currents $I_{G0}$ to $I_{G17}$ thus obtained to the data electrode driver circuit 50 at low output impedance. The transmitter circuits $\mathbf{42}_{37}$ to $\mathbf{42}_{54}$ receive the analog blue scale voltages $V_{B0}$ to $VB_{17}$ at high input impedance, respectively, and convert them to analog blue scale Currents $I_{B0}$ to $V_{D17}$, respectively. Thereafter, the transmitter circuits $\mathbf{42}_{37}$ to $\mathbf{42}_{54}$ output the analog blue scale currents $I_{B0}$ to $I_{B17}$ thus obtained to the data electrode driver circuit 50 at low output impedance.

The data electrode driver circuit 50 comprises k (k: a natural number) data electrode driver sections $\mathbf{50}_1$ to $\mathbf{50}_k$. Each of the sections $\mathbf{50}_1$ to $\mathbf{50}_k$ converts the red, green, or blue data DR, DG, or DB supplied from the controller circuit 30 in the current mode to the voltage mode and then, the circuit 50 applies the specific γ-compensation to the red, green, and blue data DR, DG, or DB thus converted based on the red, green, and blue scale currents $I_{R0}$ to $I_{R17}$, $I_{G0}$ to $I_{G17}$, $I_{B0}$ to $I_{B17}$, respectively, thereby giving gradation thereto. Then, the circuit 50 converts the red, green, and blue data DR, DG, and/or DB thus converted and compensated to 384 sub-pixel data signals D and then, outputs the signals D to the data electrodes X1 to Xn on the panel 20.

For example, if the panel 20 is designed for the SXGA resolution or mode and has 1280 pixels (horizontal)×1024 pixels (vertical) in total, the count of the sub-pixels is 3840 pixels (horizontal)×1024 pixels (vertical), because each pixel is formed by a red sub-pixel, a green sub-pixel, and a blue sub-pixel. Here, (3840 pixels)/(384 data signals)=10 (pixels/data signal). Thus, the total number of the data electrode driver sections is 10; i.e., k=10. This means that the data electrode driver circuit 50 comprises 10 data electrode driver sections $\mathbf{50}_1$, to $\mathbf{50}_{10}$. The following explanation is made under the condition described here.

The data electrode driver sections $\mathbf{50}_1$ to $\mathbf{50}_{10}$ have the same circuit configuration as each other except for the suffixes of the respective elements and the respective signals. Thus, only the section $\mathbf{50}_1$ is explained below.

Figure 9:
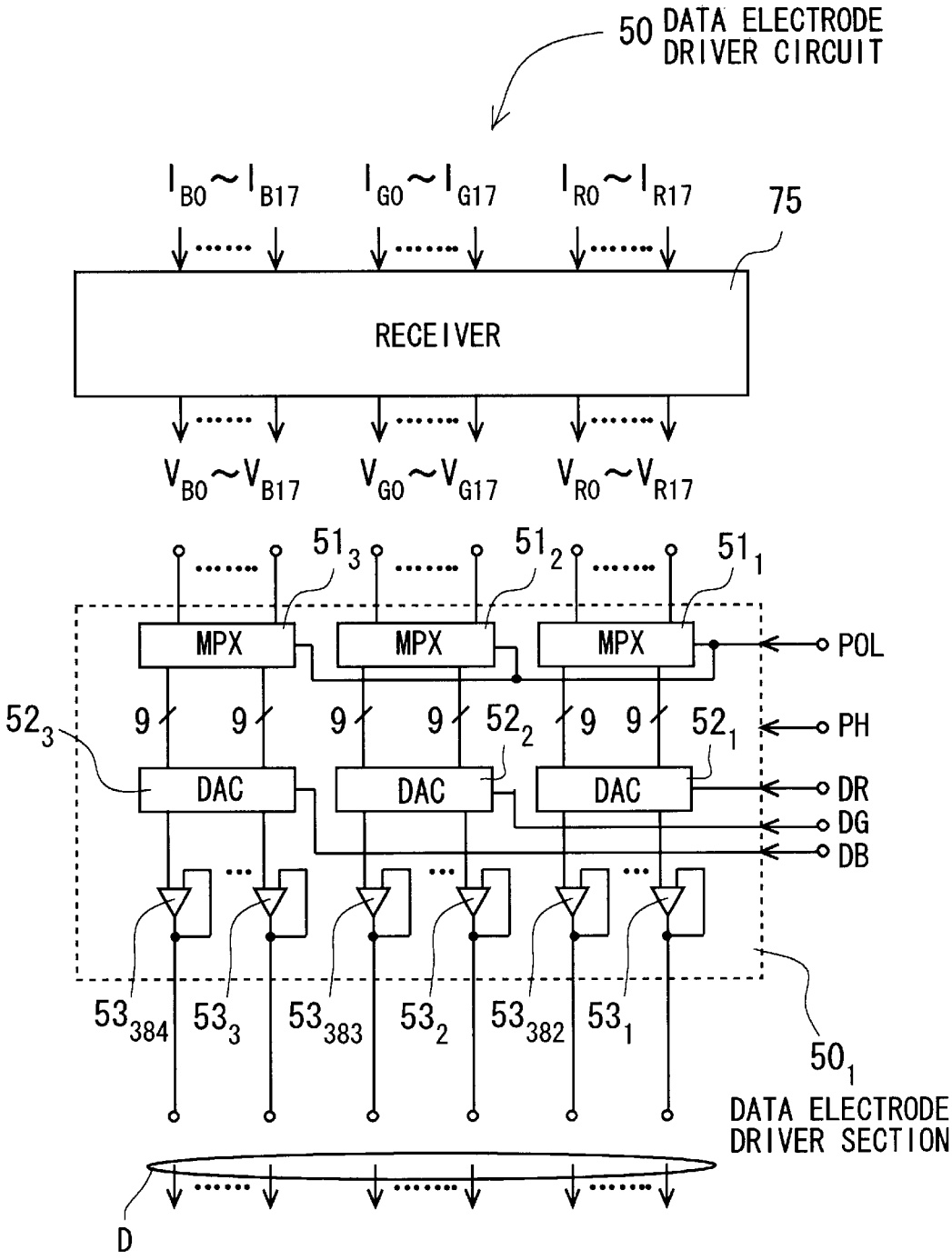
FIG. 9 is a block diagram showing the configuration of the data electrode driver section of the data electrode driver circuit used in the LCD device according to the embodiment of FIG. 7.

The data electrode driver section $\mathbf{50}_1$ of the data electrode driver circuit 50 comprises a receiver (i.e., I-V converter) section 75, three MPX circuits $\mathbf{51}_1$ to $\mathbf{51}_3$, three 8-bit DAC circuits $\mathbf{52}_1$ to $\mathbf{52}_3$, and 384 voltage follower circuits $\mathbf{53}_1$ to $\mathbf{53}_{384}$, as shown in FIG. 9.

The receiver section 75 receives the red, green, and blue scale currents $I_{R0}$ to $I_{R17}$, $I_{G0}$ to $I_{G17}$, and $I_{B0}$ to $I_{B17}$ from the gray scale power supply circuit 40, and converts them to red scale voltages $V_{R0}$ to $V_{R17}$, red green voltages $V_{G0}$ to $V_{G17}$, and blue scale voltages $V_{B0}$ to $V_{B17}$, respectively.

The MPX circuit $\mathbf{51}_1$ receives the red scale voltages $V_{R0}$ to $V_{R17}$ and then, alternately supplies the set of the red scale voltages $V_{R0}$ to $V_{R0}$ or the set of the red scale voltages $V_{R9}$ to $V_{R17}$ to the DAC circuit $\mathbf{52}_1$ according to the polarization reverse signal POL from the controller circuit 30. Similarly, the MPX circuit $\mathbf{51}_2$ receives the green scale voltages $V_{G0}$ to $V_{G17}$ and then, alternately supplies the set of the green scale voltages $V_{G0}$ to $V_{G8}$ or the set of the green scale voltages $V_{G9}$ to $V_{G17}$ to the DAC circuit $\mathbf{52}_2$ according to the polarization reverse signal POL. The MPX circuit $\mathbf{51}_3$ receives the blue scale voltages $V_{B0}$ to $V_{B17}$ and then, alternately supplies the set of the blue scale voltages $V_{B0}$ to $V_{B8}$ or the set of the blue scale voltages $V_{B9}$ to $V_{B17}$ to the DAC circuit $\mathbf{52}_3$ according to the polarization reverse signal POL.

The DAC circuit $52_1$ applies the specific γ-compensation to the 8-bit red data DR from the controller circuit 30 based on the set of the red scale voltages $V_{R0}$ to $V_{R8}$ or the set of the red scale voltages $V_{R9}$ to $V_{R17}$ from the MPX circuit $51_1$, thereby giving gradation to the red data DR. Moreover, the circuit 52, converts the digital red data DR thus compensated to analog red data signals and then, supplies them to the corresponding voltage follower circuits $53_1$, $53_4$, $53_7$, . . . , and $53_{382}$. Similarly, the DAC circuit $52_2$ applies the specific γ-compensation to the 8-bit green data DG from the controller circuit 30 based on the set of the green scale voltages $V_{G0}$ to $V_{G8}$ or the set of the green scale voltages $V_{G9}$ to $V_{G17}$ from the MPX circuit $51_2$, thereby giving gradation to the green data DR. Moreover, the circuit $52_2$ converts the digital green data DG thus compensated to analog green data signals and then, supplies them to the corresponding voltage follower circuits $53_2$, $53_5$, $53_8$, . . . , and $53_{383}$. The DAC circuit $52_3$ applies the specific γ-compensation to the 8-bit blue data DB from the controller circuit 30 based on the set of the blue scale voltages $V_{B0}$ to $V_{B8}$ or the set of the blue scale voltages $V_{B9}$ to $V_{B17}$ from the MPX circuit $51_3$, thereby giving gradation to the blue data DB. Moreover, the circuit $52_3$ converts the digital blue data DB thus compensated to analog blue data signals and then, supplies them to the corresponding voltage follower circuits $53_3$, $53_6$, $53_9$, . . . , and $53_{384}$.

The voltage follower circuits $53_1$ to $53_{384}$ receive the corresponding red, green, and blue data signals supplied from the DAC circuit $52_1$, $52_2$, and $52_3$ at high input impedance and then, they send them to the corresponding data electrodes X1 to Xn on the panel 20 at low output impedance as the sub-pixel data signals D.

The scanning electrode driver circuit 60 generates the scanning signals V to be synchronized with the vertical scanning signal PV sent from the controller circuit 2. Then, the circuit 60 supplies the scanning signals V thus generated to the corresponding scanning electrodes Y1 to Ym on the panel 20.

Figure 10:
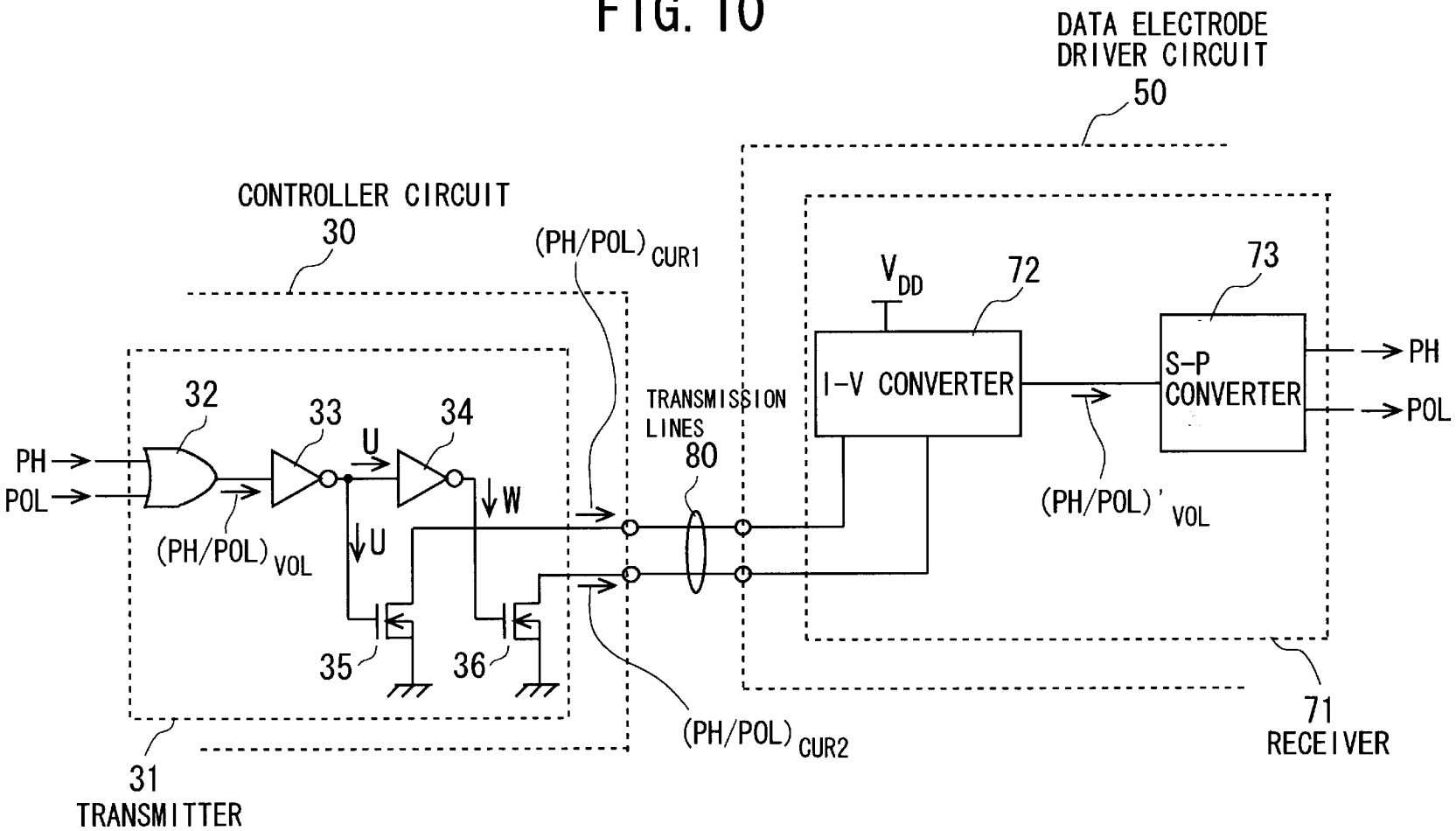
FIG. 10 is a schematic block diagram showing the configuration or the transmitter section (i.e., the first interface circuit) provided in the controller circuit and the receiver section (i.e., the second interface circuit) provided in the data electrode driver circuit used in the LCD device according to the embodiment of FIG. 7.

FIG. 10 shows an example of the circuit configuration of a transmitter section 31 provided in the controller circuit 30 and a receiver section 71 provided in the data electrode driver circuit 50. The transmitter section 31 serves as the "first interface circuit" and the receiver section 71 serves as the "second interface circuit", which are used to electrically interconnect the controller circuit 30 with the data electrode driver circuit 50.

As shown in FIG. 10, the transmitter section 31 comprises a two-input OR circuit 32, two inverter circuits 33 and 34, and two n-channel MOSFETs (Metal-Oxide-Semiconductor Field-Effect Transistors) 35 and 36. The OR circuit 32, which serves as the parallel-to-serial (P-S) converter, receives the horizontal scanning signal PH and the polarization reverse signal POL and outputs a first signal voltage $(PH/POL)_{VOL}$. The first signal voltage $(PH/POL)_{VOL}$ includes the serially arranged pulses of the signals PH and POL. The set of the inverter circuits 33 and 34 and the MOSFETs 35 and 36, which serves as the voltage-to-current (V-I) converter, converts the first signal voltage $(PH/POL)_{VOL}$ to a signal current $(PH/POL)_{CUR1}$ and a signal current $(PH/POL)_{CUR2}$. These two signal currents $(PH/POL)_{CUR1}$ and $(PH/POL)_{CUR2}$ vary complimentarily to each other. The transmitter section 31 is electrically connected to the receiver section 71 by way of transmission lines 80. The signal currents $(PH/POL)_{CUR1}$ and $(PH/POL)_{CUR2}$ are complimentarily flown from the transmitter section 31 to the receiver section 71 and vice versa by way of the corresponding lines 80.

The polarity of the first signal voltage $(PH/POL)_{VOL}$ is inverted by the inverter 33 to output the signal U. The signal U is then inverted by the inverter 34 to output the signal W. The signals U and W are respectively applied to the gates of the MOSFETs 35 and 36, thereby turning on or off the MOSFETs 35 and 36 complimentarily. As a result, the complementary signal currents $(PH/POL)_{CUR1}$ and $(PH/POL)_{CUR2}$ are generated.

The receiver section 71 comprises a current-to-voltage (I-V) converter circuit 72 and a serial-to-parallel (S-P) converter circuit 73, as shown in FIG. 10. "$V_{DD}$" denotes the power supply voltage. The I-V converter circuit 72 converts the complementary signal currents $(PH/POL)_{CUR1}$ and $(PH/POL)_{CUR2}$ transmitted by way of the lines 80 to a second signal voltage $(PH/POL)'_{VOL}$. The S-P converter circuit 73 converts the second signal voltage $(PH/POL)'_{VOL}$ to the horizontal scanning signal PH and the polarization reverse signal POL, which are outputted from the circuit 73 in parallel.

Figure 12:
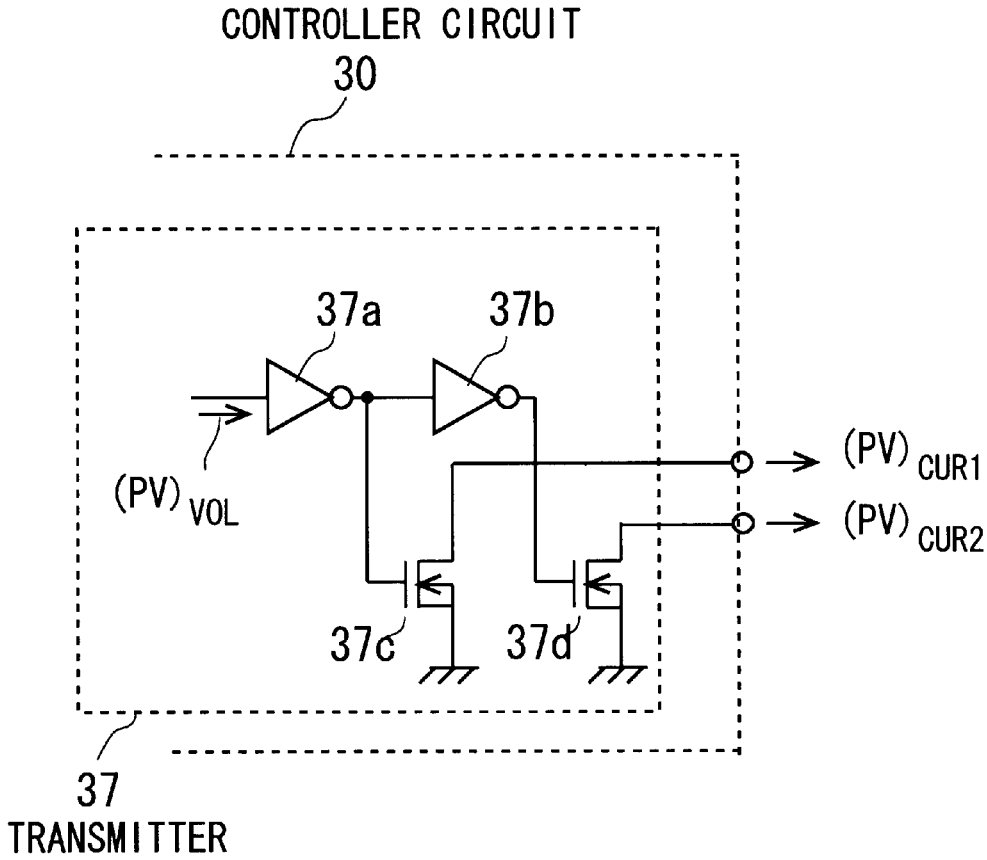
FIG. 12 is a schematic circuit diagram of the transmitter section provided in the controller circuit of the LCD device according to the embodiment of FIG. 7, which is used for converting the vertical scanning signal PV in the voltage mode to the current mode.

As shown in FIG. 7, the controller circuit 30 comprises a transmitter section 37 for the horizontal scanning signal PV and a transmitter section 38 for red, green, and blue data DR, DG, and DB. The transmitter section 37 converts the horizontal scanning signal PV in the voltage mode (i.e., $(PV)_{VOL}$) to the current mode (i.e., $(PV)_{CUR1}$ and $(PV)_{CUR2}$) and then, transmits the same to the scanning electrode driver circuit 60. The transmitter section 37 has the circuit configuration shown in FIG. 12, which is the same as the configuration obtained by eliminating the OR circuit 32 from the transmitter section 31 for the signals PH and POL shown in FIG. 10. On the other hand, the transmitter section 38 converts the red, green, and blue data DR, DG, and DB in the voltage mode to the current mode and then, transmits the same to the data electrode driver circuit 50. The transmitter section 38 has the same circuit configuration as shown in FIG. 12 for each of the data DR, DG, and DB.

Figure 13:
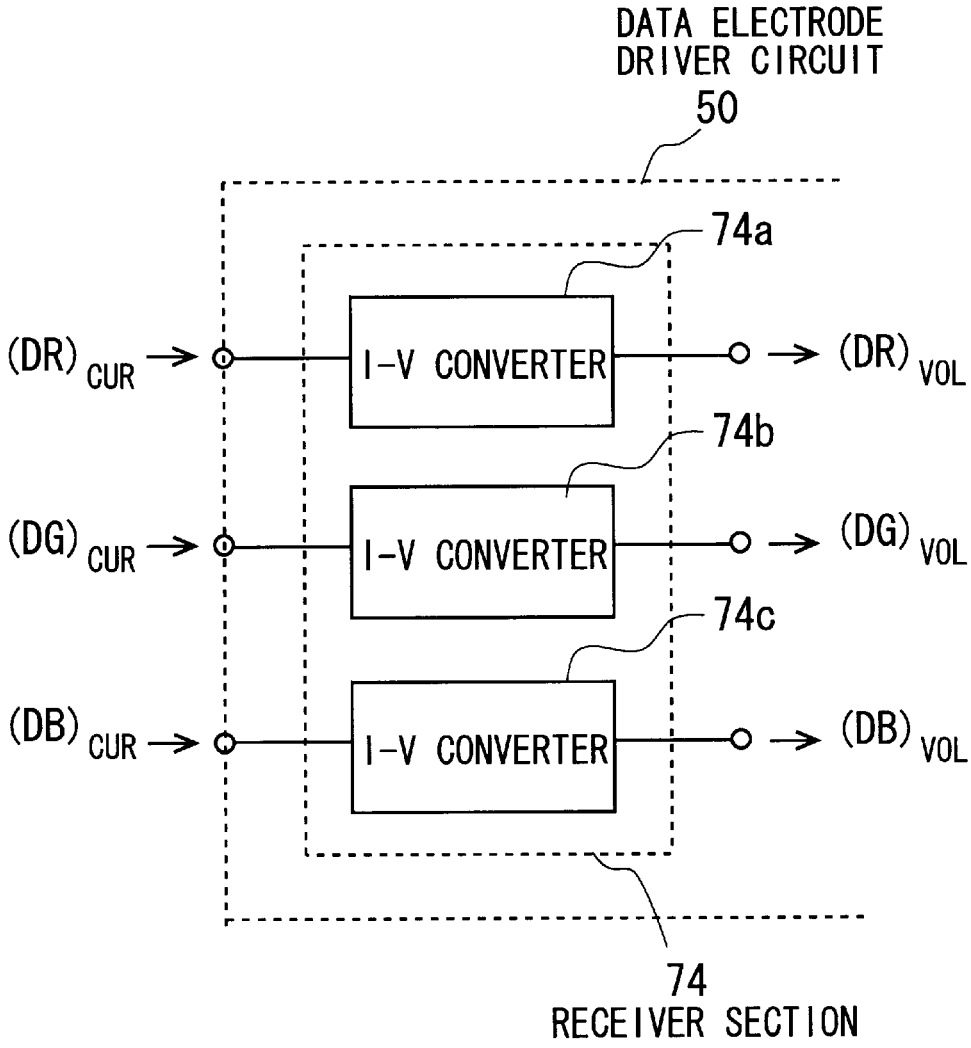
FIG. 13 is a schematic circuit diagram of the receiver section provided in the data electrode driver circuit of the LCD device according to the embodiment of FIG. 7, which is used for converting the red, green, and blue data in the current mode to the voltage mode.

The data electrode driver circuit 50 comprises a receiver section 74 for the red, green, and blue data DR, DG, and DB and a receiver section 75 for the red, green, and blue scale currents $I_{R0}$ to $I_{R17}$, $I_{G0}$ to $I_{G17}$, and $I_{B0}$ to $I_{B17}$. The receiver section 74 converts the red, green, and blue data DR, DG, and DB in the current mode (i.e., $(DR)_{CUR}$, $(DG)_{CUR}$, and $(DBR)_{CUR}$) to the voltage mode (i.e., $(DR)_{VOL}$, $(DG)_{VOL}$, and $(DBR)_{VOL}$), respectively, and then, transmits the same to the data electrodes X1 to Xn on the panel 20. The receiver section 74 has the circuit configuration shown in FIG. 13, which is the same as the configuration obtained by eliminating the S-P converter 73 from the receiver section 71 for the signals PH and POL (see FIG. 10). On the other hand, the receiver section 75 converts the red, green, and blue scale currents $I_{R0}$ to $I_{R17}$, $I_{G0}$ to $I_{G17}$, and $I_{B0}$ to $I_{B17}$ to the voltage mode. The receiver section 75 has substantially the same circuit configuration as shown in FIG. 13.

Figure 11:
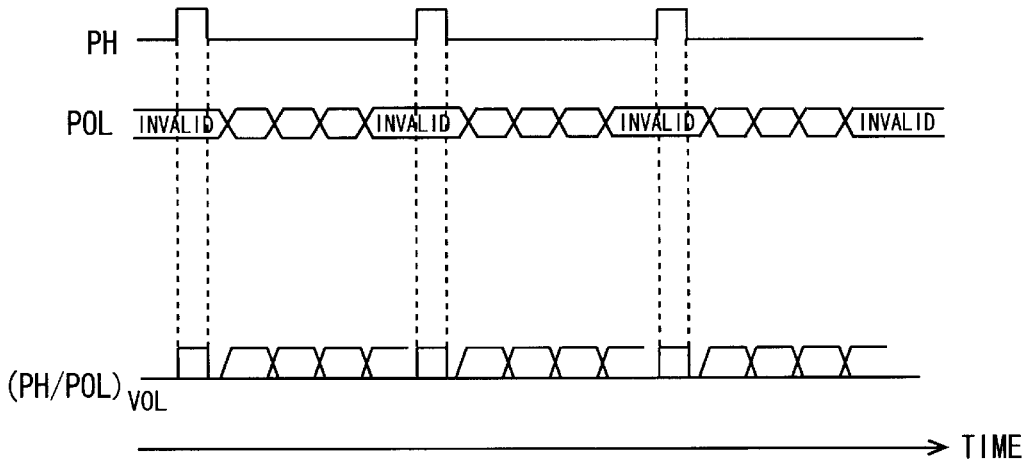
FIG. 11 is a timing diagram showing the operation of the LCD device according to the embodiment of FIG. 7, in which the serially transmitted, current-mode signal PH/POL is shown, in addition to the horizontal scanning signal PH and the polarization reverse signal POL.

FIG. 11 shows the timing diagram for explaining the operation of the LCD device of the embodiment of FIG. 7. The method of signal transmission in the embodiment is described below with reference to FIGS. 10 and 11.

In the LCD device of the embodiment of FIG. 7, as shown in FIG. 11, the polarization reverse signal POL and the horizontal scanning signal PH have their active mode periods at different timings. Specifically, when the horizontal scanning signal PH is in its active mode (i.e., in the logic high level), the polarization reverse signal POL is not in its active mode but is in its invalid state. On the other hand, when the polarization reverse signal POL is in its active mode, the horizontal scanning signal PH is not in its active mode.

The polarization reverse signal POL and the horizontal scanning signal PH, which are generated in parallel in the controller circuit 30, are converted to the first voltage signal $(PH/POL)_{VOL}$ by the OR circuit 32 in the transmitter section 31, which includes the pulses of the signals POL and PH arranged in series. This is the parallel-to-serial conversion process. The first voltage signal $(PH/POL)_{VOL}$ is then converted to the current signals $(PH/POL)_{CUR1}$ and $(PH/POL)_{CUR2}$ by the V-I converter (which is formed by the inverters 33 and 34 and the MOSFETs 35 and 36) in the transmitter section 31. This is the voltage-to-current conversion process. Thereafter, the complementary current signals $(PH/POL)_{CUR1}$ and $(PH/POL)_{CUR2}$ thus obtained are transmitted to the receiver section 71 of the data electrode driver circuit 50 by way of the transmission lines 80.

In the receiver section 71, the current signals $(PH/POL)_{CUR1}$ and $(PH/POL)_{CUR2}$ are Converted to the second voltage signal $(PH/POL)'_{VOL}$ by the I-V converter 72. This is the current-to-voltage conversion process. Thereafter, the second voltage signal $(PH/POL)'_{VOL}$ is converted to the polarization reverse signal POL and the horizontal scanning signal PH in parallel by the S-P converter 73. This is the serial-to-parallel conversion process.

As shown in FIG. 9, the red scale currents $I_{R0}$ to $I_{R17}$, which are supplied from the gray scale power supply circuit 40, are converted to the voltage mode (i.e., $V_{R0}$ to $V_{R17}$) by the receiver section 75 of the data electrode driver circuit 50. Then, they are inputted into the MPX circuit $\mathbf{51}_1$ to be synchronized with the horizontal scanning signal PH. Thereafter, the set of the red scale voltages $V_{R0}$ to $V_{RB}$ or the set of the red scale voltages $V_{R9}$ to $V_{R17}$ are alternately supplied to the DAC circuit $\mathbf{52}_1$ according to the polarization reverse signal POL. Similarly, the green scale currents $I_{G0}$ to $I_{G17}$, which are supplied from the gray scale power supply circuit 40, are converted to the voltage mode (i.e., $V_{G0}$ to $V_{G17}$) by the receiver section 75 of the circuit 50. Then, they are inputted into the MPX circuit $\mathbf{51}_2$ to be synchronized with the horizontal scanning signal PH. Thereafter, the set of the green scale voltages $V_{G0}$ to $V_{GB}$ or the set of the green scale voltages $V_{G9}$ to $V_{G17}$ are alternately supplied to the DAC circuit $\mathbf{52}_2$ according to the polarization reverse signal POL. The blue scale currents $I_{B0}$ to $I_{B17}$, which are supplied from the gray scale power supply circuit 40, are converted to the voltage mode (i.e., $V_{B0}$ to $V_{B17}$) by the receiver section 75 of the circuit 50. Then, they are inputted into the MPX circuit $\mathbf{51}_3$ to be synchronized with the horizontal scanning signal PH. Thereafter, the set of the blue scale voltages $V_{B0}$ to $V_{B8}$ or the set of the blue scale voltages $V_{B9}$ to $V_{B17}$ are alternately supplied to the DAC circuit $\mathbf{52}_3$ according to the polarization reverse signal POL.

The 8-bit red data DR, which are supplied from the controller circuit 30 and inputted into the DAC circuit 521, are subjected to the γ-compensation based on the set of the red scale voltages $V_{R0}$ to $V_{R8}$ or the set of the red scale voltages $V_{R9}$ to $V_{R17}$, thereby giving the gradation to the data DR. At the same time as this, the red data DR are converted to the analog red data signals. The analog red data signals thus obtained are supplied to the corresponding voltage follower circuits $\mathbf{53}_1$, $\mathbf{53}_4$, $\mathbf{53}_7$, . . . , and $\mathbf{53}_{382}$. Similarly, the 8-bit green data DG, which are supplied from the controller circuit 30 and inputted into the DAC circuit $\mathbf{52}_2$, are subjected to the γ-compensation based on the set of the green scale voltages $V_{G0}$ to $V_{G8}$ or the set of the green scale voltages $V_{G9}$ to $V_{G17}$, thereby giving the gradation to the data DG. At the same time as this, the green data DG are converted to the analog green data signals. The analog green data signals thus obtained are supplied to the corresponding voltage follower circuits $\mathbf{53}_2$, $\mathbf{53}_5$, $\mathbf{53}_8$, . . . , and $\mathbf{53}_{383}$. The 8-bit blue data DB, which are supplied from the controller circuit 30 and inputted into the DAC circuit $\mathbf{52}_3$, are subjected to the γ-compensation based on the set of the blue scale voltages $V_{B0}$ to $V_{B8}$ or the set of the blue scale voltages $V_{B9}$ to $V_{B17}$, thereby giving the gradation to the data DB. At the same time as this, the blue data DB are converted to the analog blue data signals. The analog blue data signals thus obtained are supplied to the corresponding voltage follower circuits $\mathbf{53}_3$, $\mathbf{53}_6$, $\mathbf{53}_9$, . . . , and $\mathbf{53}_{384}$.

The analog red, green, and blue data signals thus obtained are sent to the corresponding data electrodes X1 to Xn as the sub-data signals D.

The vertical scanning signal PV is supplied to the scanning electrode driver circuit 60 from the controller circuit 30. The scanning signals V are generated and outputted by the circuit 60 to the scanning electrodes Y1 to Ym to be synchronized with the signal PV. In the panel 20, the sub-pixel data signals D are respectively supplied to the specific sub-pixel regions chosen by the scanning signals V, thereby displaying desired color images on the screen (not shown) of the panel 20 according to the sub-pixel data signals D thus supplied.

With the above-described LCD device according to the embodiment of the invention, the horizontal and vertical scanning signals PH and PV, the polarization reverse signal POL, the red, green, and blue data DR, DG, and DB, and the red, green, and blue scale voltages $V_{R0}$ to $V_{R17}$, $V_{G0}$ to $V_{G17}$, and $V_{B0}$ to $V_{B17}$ are all converted to the current mode and then, they are transmitted by way of the transmission lines 80. Therefore, the phase rotation in the high-frequency regions of the signals to be transmitted in the device are prevented or suppressed effectively, which improves the quality of images on the screen of the panel 20. Moreover, high-frequency noises are suppressed and thus, the EMI to other electronic equipment can be avoided.

Furthermore, the horizontal scanning signal PH and the polarization reverse signal POL are transmitted serially in the current mode to the data electrode driver circuit 50 by way of the common transmission lines. Therefore, the total number of required transmission lines is reduced. This means that the device of the embodiment can cope with the tendency to make the device itself more compact.

VARIATIONS

Needless to say, the present invention is not limited to the above-described embodiment, because this embodiment is a preferred example of the invention. Any change or modification may be added to them within the spirit of the invention.

For example, the period for AC driving the LCD panel 20 may be set to be equal to one frame period or the period of the specific horizontal lines. The circuit configuration of the transmitter section 31 of the controller circuit 30 may be optionally changed if it has a function of converting the signal voltage (PH/POL) to the current mode.

While the preferred forms of the present invention have been described, it is to be understood that modifications will be apparent to those skilled in the art without departing from the spirit of the invention. The scope of the present invention, therefore, is to be determined solely by the following claims.

What is claimed is:

1. A liquid-crystal display (LCD) device comprising:

a LCD panel having data electrodes for receiving pixel data signals, scanning electrodes for receiving scanning signals, and pixel regions located at intersections of the data electrodes and the scanning electrodes;

part of the pixel regions being chosen by the scanning signals;

the pixel data signals being applied to the part of the pixel regions, displaying images corresponding to the pixel data signals applied;

a data electrode driver circuit for receiving an image input signal to be synchronized with a horizontal scanning signal, for polarization-reversing the pixel data signals corresponding to the image input signal based on a polarization reverse signal, and for transmitting the pixel data signals thus polarization-reversed to the data electrodes of the panel;

a scanning electrode driver circuit for transmitting scanning signals to the scanning electrodes of the panel to be synchronized with a vertical scanning signal; and a controller circuit for outputting the image input signal, the polarization reverse signal, the horizontal scanning signal, and the vertical scanning signal;

wherein the controller circuit comprises a first interface circuit for receiving the polarization reverse signal and the horizontal scanning signal in parallel in such a way that the polarization reverse signal and the horizontal scanning signal have their active mode periods at different timings, for generating a serial signal from the polarization reverse signal and the horizontal scanning signal, and for transmitting the serial signal to the data electrode driver circuit by way of a transmission line or lines;

and wherein the data electrode driver circuit comprises a second interface circuit for regenerating the polarization reverse signal and the horizontal scanning signal in parallel from the serial signal.

2. The device according to claim 1, wherein the device has a configuration that the serial signal is transmitted in a current mode.

3. The device according to claim 1, wherein the first interface circuit comprises a parallel-to-serial converter circuit for converting the polarization reverse signal and the horizontal scanning signal transmitted in parallel to a first serial signal voltage; and a voltage-to-current converter circuit for converting the first serial signal voltage to a signal current;

the signal current being outputted to the transmission line or lines;

and wherein the second interface circuit comprises a current-to-voltage converter circuit for converting the signal current to a second signal voltage; and a serial-to-parallel converter circuit for converting the second signal voltage to the polarization reverse signal and the horizontal scanning signal in parallel.

4. The device according to claim 1, wherein the data electrode driver circuit comprises at least one data electrode driver section according to a count of the data electrodes.

5. A method of transmitting signals in a liquid-crystal display (LCD) device;

the device comprising:

a LCD panel having data electrodes for receiving pixel data signals, scanning electrodes for receiving scanning signals, and pixel regions located at intersections of the data electrodes and the scanning electrodes;

part of the pixel regions being chosen by the scanning signals;

the pixel data signals being applied to the part of the pixel regions, displaying images corresponding to the pixel data signals applied;

a data electrode driver circuit for receiving an image input signal to be synchronized with a horizontal scanning signal, for polarization-reversing the pixel data signals corresponding to the image input signal based on a polarization reverse signal, and for transmitting the pixel data signals thus polarization-reversed to the data electrodes of the panel;

a scanning electrode driver circuit for transmitting scanning signals to the scanning electrodes of the panel to be synchronized with a vertical scanning signal; and a controller circuit for outputting the image input signal, the polarization reverse signal, the horizontal scanning signal, and the vertical scanning signal;

the method comprising the steps of;

in the controller circuit, receiving the polarization reverse signal and the horizontal scanning signal in parallel in such a way that the polarization reverse signal and the horizontal scanning signal have their active mode periods at different timings; generating a serial signal from the polarization reverse signal and the horizontal scanning signal; and transmitting the serial signal to the data electrode driver circuit by way of a transmission line or lines; and in the data electrode driver circuit, regenerating the polarization reverse signal and the horizontal scanning signal in parallel from the serial signal.

6. The method according to claim 5, wherein the serial signal is transmitted in a current mode.

7. The method according to claim 5, wherein the controller circuit conducts a parallel-to-serial conversion step for converting the polarization reverse signal and the horizontal scanning signal transmitted in parallel to a first serial signal voltage; and a voltage-to-current conversion step for converting the first serial signal voltage to a signal current;

the signal current being outputted to the transmission line or lines;

and wherein the data electrode converter circuits conducts a current-to-voltage conversion step for converting the signal current to a second signal voltage; and a serial-to-parallel conversion step for converting the second signal voltage to the polarization reverse signal and the horizontal scanning signal in parallel.

* * * * *